United States Patent [19]

Derrick

[11] Patent Number: 4,819,809

[45] Date of Patent: Apr. 11, 1989

[54] REINFORCED POLYURETHANE VIBRATORY SCREEN

[75] Inventor: James W. Derrick, East Aurora, N.Y.

[73] Assignee: Derrick Manufacturing Corporation, Buffalo, N.Y.

[21] Appl. No.: 70,102

[22] Filed: Jan. 1, 1987

Related U.S. Application Data

[63] Continuation of Ser. No. 773,994, Sep. 9, 1985, abandoned.

[51] Int. Cl.[4] ..... B07B 1/06

[52] U.S. Cl. ..... 209/275; 209/392; 209/400; 428/109; 428/294; 428/295; 428/902

[58] Field of Search ..... 209/275, 281, 352, 400, 209/401, 403, 392; 428/294, 295, 107, 108, 109, 902

[56] References Cited

U.S. PATENT DOCUMENTS

| | | | |
|---|---|---|---|
| 966,578 | 8/1910 | Murphy et al. | 209/403 |
| 1,361,772 | 12/1920 | Ouellette | 209/403 |
| 2,010,256 | 8/1935 | Cole | 209/401 |
| 3,664,503 | 5/1972 | Felden | 209/397 |
| 3,718,963 | 3/1973 | Hawkins et al. | 209/403 |
| 3,811,570 | 5/1974 | Holding et al. | 209/399 |
| 3,943,054 | 3/1976 | Simonson | 209/392 |
| 3,970,549 | 7/1976 | Ennis et al. | 209/341 |
| 3,970,550 | 7/1976 | Fry et al. | 209/399 |
| 3,980,555 | 9/1976 | Freissle | 209/408 |
| 4,120,784 | 10/1978 | Hassall | 209/399 |
| 4,120,785 | 10/1978 | Kanamori et al. | 209/392 |
| 4,222,865 | 9/1980 | Valeri et al. | 209/399 |
| 4,247,007 | 1/1981 | Kai | 209/392 |
| 4,265,742 | 5/1981 | Bucker et al. | 209/399 |
| 4,278,535 | 7/1981 | Wolff | 209/399 |
| 4,347,129 | 8/1982 | Rutherford | 209/399 |
| 4,383,919 | 5/1983 | Schmidt | 209/399 |
| 4,409,099 | 10/1983 | Wolff | 209/399 |
| 4,473,466 | 9/1984 | Schmidt et al. | 209/397 |
| 4,483,381 | 11/1984 | Scriver | 478/295 |
| 4,510,202 | 4/1985 | Hatchard | 428/295 |

FOREIGN PATENT DOCUMENTS

| | | | |
|---|---|---|---|
| 736190 | 9/1955 | United Kingdom | 209/401 |

*Primary Examiner*—Andres Kashnikow
*Assistant Examiner*—Michael J. Forman
*Attorney, Agent, or Firm*—Joseph P. Gastel

[57] ABSTRACT

A molded polyurethane vibratory screen including a body having opposite side edge portions, upper and lower edge portions, an upper surface and a lower surface, a plurality of major and minor substantially parallel ribs extending between the upper and lower edge portions and substantially parallel to the side edge portions, dividing strips extending between the major and minor ribs to define screen openings therebetween, aramid fibers extending between the side edge portions and through the dividing strips to provide tensile strength to the dividing strips, and upper triangular cross section portions formed integrally with the major and minor ribs and extending above the upper surface of the screen to direct foreign matter laterally toward the screen openings.

24 Claims, 1 Drawing Sheet

REINFORCED POLYURETHANE VIBRATORY SCREEN

This is a continuation, of Application Ser. No. 773,994, filed 9/21/85, now abandoned.

BACKGROUND OF THE INVENTION

The present invention relates to an improved molded polyurethane screen.

By way of background, molded polyurethane screens which have reinforcement therein are known in the art. However, in the past the dividing strips between the openings were relatively large, thereby causing the open area of the screen to be an undesirably low percentage of its surface, thereby in turn causing the screen to be relatively inefficient.

SUMMARY OF THE INVENTION

It is one object of the present invention to provide an improved molded polyurethane screen which has a relatively high percentage of open area to thereby produce high efficiency because the dividing strips between the screen openings can be made relatively narrow since they are reinforced by high tensile strength reinforcing materials which are relatively small in diameter.

Another object of the present invention is to provide an improved molded reinforced polyurethane screen which includes upper rib portions above the upper surface of the screen which are of a shape to direct water and material to be screened toward the screen openings. Other objects and attendant advantages of the present invention will readily be perceived hereafter.

The present invention relates to a vibratory screen comprising a molded polyurethane body, screen openings in said body, substantially parallel dividing strips on opposite sides of said screen openings, and elongated aramid fibers molded integrally with said dividing strips to impart tensile strength thereto.

The present invention also relates to a vibratory screen comprising a body having side edge portions and upper and lower edge portions and an upper surface and a lower surface, a plurality of substantially parallel dividing strips extending longitudinally between said side edge portions to define edges of screen openings therebetween, rib means extending transversely to said dividing strips to define ends of said screen openings, and ridge means extending above said upper surface in a direction transverse to said dividing strips for directing material into said openings.

The present invention will be more fully understood when the following portions of the specification are read in conjunction with the accompanying drawings wherein:

BRIEF DESCRIPTION OF THE DRAWINGS

FIG. 8 is a fragmentary cross sectional view showing the manner in which the improved screen of FIG. 1 is mounted in a vibratory screening machine.

DESCRIPTION OF THE PREFERRED EMBODIMENTS

Figures 1, 2, 3, 4, 5, 6, 7:
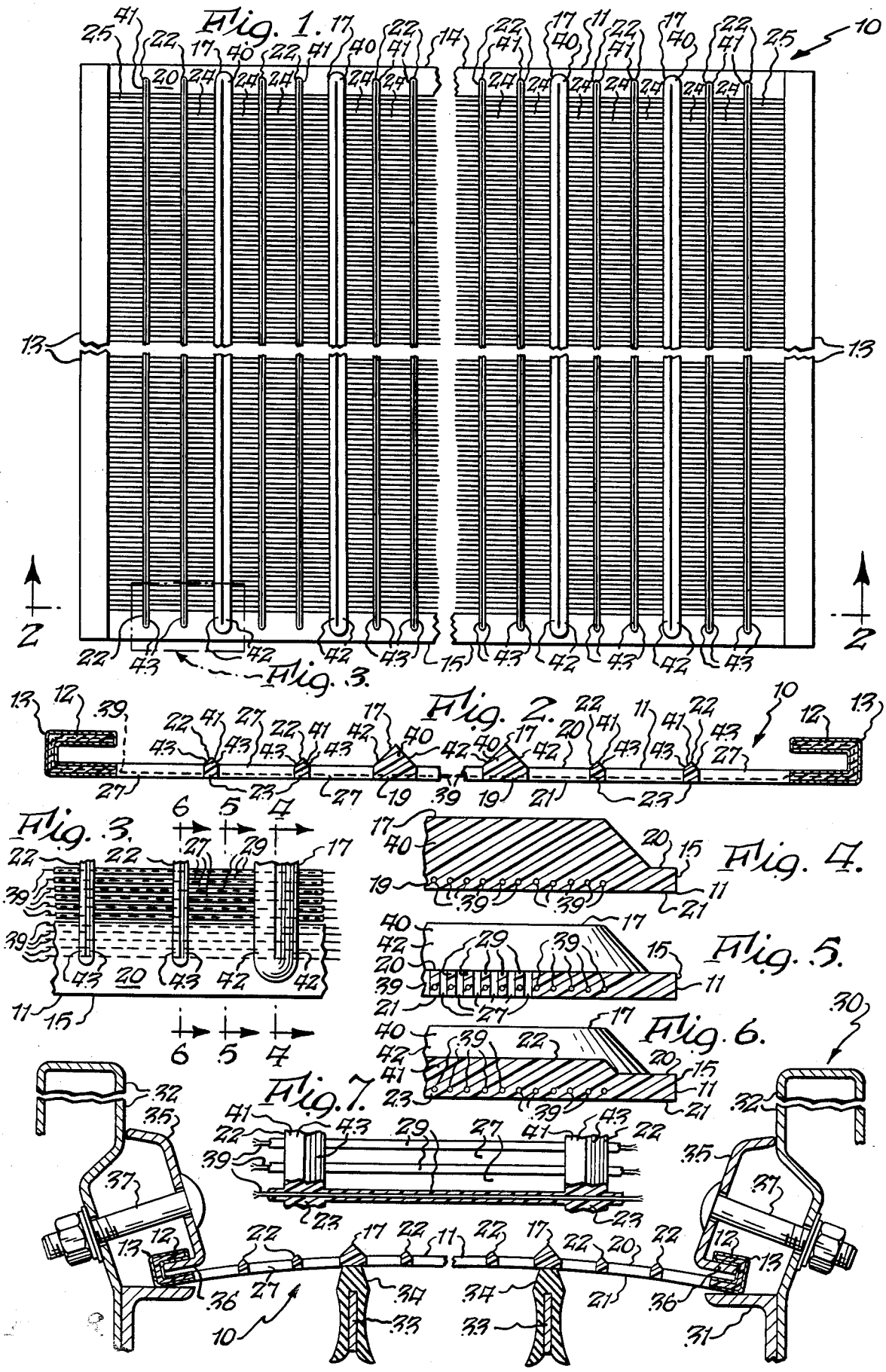
FIG. 1 is a fragmentary plan view of the improved vibratory screen of the present invention.
FIG. 2 is a fragmentary cross sectional view taken substantially along line 2—2 of FIG. 1.
FIG. 3 is a fragmentary enlarged view of the portion labeled FIG. 3 of FIG. 1.
FIG. 4 is a fragmentary cross sectional view taken substantially along line 4—4 of FIG. 3.
FIG. 5 is a fragmentary cross sectional view taken substantially along line 5—5 of FIG. 3.
FIG. 6 is a fragmentary cross sectional view taken substantially along line 6—6 of FIG. 3.
FIG. 7 is a fragmentary enlarged view of a portion of FIG. 3.

The vibratory screen 10 includes a body 11 of molded polyurethane having unperforated side edge portions 12 which are encased in a U-shaped metal frame 13 for mounting in a vibratory screening machine, as is well known. The body 11 also includes an upper edge portion 14 and a lower edge portion 15 which, in combination with side edge portions 12, define the outer border of the screen 10.

A plurality of relatively large major ribs 17 extend between edge portions 14 and 15 and include lower rib portions 19 (FIG. 2) which are located between upper surface 20 and lower surface 21 of body 11. In addition, a plurality of relatively small substantially parallel minor ribs 22 also extend between edge portions 14 and 15 and include portions 23 which are located between upper surface 20 and lower surface 21. Thus, ribs 17 and 22 divide body 11 into a plurality of column-like spaces 24. In addition two column-like spaces 25 are defined by the outermost ribs 22 and side edge portions 12.

The column-like spaces 24 and 25 are further divided into openings 27 by dividing strips 29 which are molded integrally with the ribs 22 and 17 at opposite ends thereof. The openings 27 are, in accordance with the present invention, 1.5 mm wide and approximately 25 mm long. However, the width may be slightly larger, on the order of about 2 or 3 mm, or as small as 0.25 mm wide. The distance between upper surface 20 and lower surface 21 may be approximately 3 mm.

In use, the vibratory screen 10 is mounted on a vibratory screening machine 30 (FIG. 8) in the well known manner. More specifically, it is mounted on the screen deck bed 31 which is mounted on the frame (not shown) of the machine. The screen deck bed 31 consists of spaced substantially parallel frame members 32 secured to each other by spaced substantially parallel cross frame members (not shown). Extending transversely between the cross frame members are a plurality of substantially parallel stringers 33 which mount channel rubbers 34. Mounted on parallel frame members 32 are channel-shaped draw bars 35 having lower portions 36 which are received within channel members 13. Draw bolts 37 draw bars 35 apart to thereby tension vibratory screen 10 with the required force. The foregoing type of screen deck bed is well known in the art.

The polyurethane is flexible and has a creep characteristic so that, if unmodified, it will stretch and lay loosely on members 34, rather than tightly, as required. In order to overcome the foregoing, aramid fibers 39 extend longitudinally of and are embedded in dividers 29. Each fiber 39 extends completely across body 11 including the side edge portions 12. The continuous fibers 39 have a tensile strength which is greater than steel and thus they prevent the body 14 from elongating between side edge portions 12 when it is mounted under high tension on the vibratory screening machine, as shown in FIG. 8. Preferably fibers 39 are slightly tensioned before the polyurethane is molded around them. In addition, fibers 39 are preferably multistrand so that they act in the nature of wicks to absorb the polyurethane which is molded around them to thereby provide an extremely good bond therewith. The flexibility of the aramid fibers 39 thus provides a flexible reinforcement system for the molded polyurethane which therefore is able to always return to its original molded shape regardless of the necessary bending and flexing during handling and installation into the vibratory frame member 32. Furthermore, the flexible aramid fibers permit the flexible polyurethane screen to be flexed without harm into an arcuate condition and tensioned as shown in FIG. 8. During operation, the thin flexible dividing strips 29 will vibrate to enhance the screening action. In this regard, it is to be noted that because dividing strips 29 are flexible and relatively thin and only slightly wider than fibers 39, they will provide a relatively high amplitude of desirable vibration. The reason the reinforced dividing strips 29 can be made relatively thin is because the aramid fibers are about four times the tensile strength of steel and therefore can provide the required reinforcement while requiring only about one-fourth of the cross sectional area which would be required for steel. In addition, the making of the dividing strips relatively thin results in the screen having a greater percentage of open area than a screen with steel reinforcement would have, which, in turn, increases its capacity. The fibers 39 are located in the bottom halves of dividing strips 29 so as not to be exposed relatively early as the upper surface of the screen wears. The aramid fibers are commercially obtainable under the trademark KEVLAR of the Dupont Company and are further identified by the designation B29/6×02. Fiber strands 39 are preferably 0.5 mm in diameter and the individual filaments therein are in the order of 0.01 mm in diameter.

Further in accordance with the present invention, the major ribs 17 and the minor ribs 22 each include upper ridge portions 40 and 41, respectively, which are triangular in cross section. Triangular ridge portions 40 and 41 extend above upper surface 20, and the bases of triangular portions 40 and 41 lie substantially in the plane of upper surface 20. Thus, the sloping sides 42 and 43 of upper triangular portions 40 and 41, respectively, will direct water and the material being screened laterally into the openings 27 adjacent thereto. This insures that the material to be screened will not pass downwardly along the ribs, and thus avoid being exposed to the openings.

By way of further dimensions, dividing strips 29 in the particular screen are approximately one mm wide. The lower major rib portions 19 are approximately 15 mm wide and the height of triangular portions 40 above upper surface 21 is approximately 7 mm. The lower minor rib portions 23 are approximately 3 mm wide and the height of triangular rib portions 41 above surface 21 is approximately 2 mm. The overall dimensions of screen 10 may be about 1.2 meters times 1.6 meters, or any other desired size. All of the dimensions are by way of example and not of limitation.

While preferred embodiments of the present invention have been disclosed, it will be appreciated that it is not limited thereto but may be otherwise embodied within the scope of the following claims.

What is claimed is:

1. A vibratory screen comprising a flexible molded polyurethane body, screen openings in said body, substantially parallel flexible dividing strips defining opposite sides of said screen openings, elongated flexible aramid fibers molded integrally with said flexible dividing strips to impart tensile strength to said screen while maintaining flexibility thereof, said body having side edge portions at opposite ends of said body between which said fibers extend to enable tensioning of said body along the length of said fibers and strips, said openings being elongated with a greater length dimension along said sides and between ends thereof than a width dimension between said sides and with their length dimensions extending in a direction transverse to said side edge portions, said body having an upper surface and a lower surface, integrally molded ribs extending transversely to said dividing strips and having portions extending upwardly above said upper surface, and said ribs comprising relatively large ribs alternating with relatively small ribs.

2. A vibratory screen as set forth in claim 1 wherein said fibers are multistrand, and wherein said polyurethane impregnates said multistrand fibers to thereby provide an intimate bond between said dividing strips and said fibers.

3. A vibratory screen as set forth in claim 1 wherein said portion of said ribs which extend above said upper surface are substantially triangular in cross-section with apexes projecting away from said upper surface.

4. A vibratory screen as set forth in claim 3 wherein said triangular portions include opposite sides which slope downwardly toward said screen openings.

5. A vibratory screen as set forth in claim 4 wherein said fibers are multistrand, and wherein said polyurethane impregnates said multistrand fibers to thereby provide an intimate bond between said dividing strips and said fibers.

6. A vibratory screen as set forth in claim 4 wherein said relatively large ribs are spaced to overlay and rest on supporting stringers of a vibratory screening machine.

7. A vibratory screen for mounting on a vibratory screening machine comprising an integral flexible molded polyurethane body having a creep characteristic, an upper surface and a lower surface on said body, side edge portions forming an integral molded portion of said body, screen openings in said body extending between said upper and lower surfaces, flexible dividing strips forming an integral molded portion of said body and defining opposite sides of each of said screen openings, ribs molded integrally with said dividing strips and extending transversely thereto and defining the ends of said openings, said openings being elongated with a greater length dimension along said sides and between said ribs than a width dimension between said sides and with their length dimensions extending in a direction transverse to said side edge portions, and continuous elongated flexible aramid fibers molded integrally with each of said flexible dividing strips and extending continuously throughout said body and into said side edge portions for enabling tensioning of both said dividing strips and said fibers in a direction along the length of said flexible aramid fibers and said flexible dividing strips when tensile forces are applied to said side edge portions and said fibers therein and thus preventing said body from elongating between said side edge portions due to said creep characteristic while permitting said dividing strips to vibrate due to their flexibility when said body is mounted under high tension and is being operated on said vibratory screening machine, said aramid fibers and said molded polyurethane body being sufficiently flexible to enable said vibratory screen to be bent into an arcuate condition for installation into said vibratory screening machine.

8. A vibratory screen as set forth in claim 7 wherein said fibers are multistrand, and wherein said polyurethane impregnates said multistrand fibers to thereby provide an intimate bond between said dividing strips and said fibers.

9. A vibratory screen as set forth in claim 1 wherein said fibers are multistrand, and wherein said polyurethane impregnates said multistrand fibers to thereby provide an intimate bond between said dividing strips and said fibers.

10. A vibratory screen as set forth in claim 7 wherein said ribs include portions which extend above said upper surface and are substantially triangular in cross-section.

11. A vibratory screen as set forth in claim 10 wherein said fibers are multistrand, and wherein said polyurethane impregnates said multistrand fibers to thereby provide an intimate bond between said dividing strips and said fibers.

12. A vibratory screen as set forth in claim 7 wherein said body has an upper surface and a lower surface, said dividing strips have upper and lower halves respectively facing said upper surface and said lower surface, and said fibres are positioned in the lower halves of said dividing strips.

13. A vibratory screen as set forth in claim 12 wherein said integrally molded ribs also extend upwardly above said upper surface.

14. A vibratory screen as set forth in claim 13 wherein said ribs include portions which are substantially triangular in cross-section and which have apexes projecting upwardly from and above said top surface.

15. A vibratory screen as set forth in claim 7 wherein said flexible dividing strips are relatively thin and only slightly wider than said flexible aramid fibers to provide a relatively high amplitude of vibration.

16. A vibratory screen as set forth in claim 15 wherein said flexible aramid fibers are about 0.5 mm in diameter.

17. A vibratory screen as set forth in claim 15 wherein said openings are between about 1.5 mm and 3 mm between said opposite sides of said openings.

18. A vibratory screen as set forth in claim 15 wherein said openings are as narrow as 0.25 mm between said opposite sides of said openings.

19. A vibratory screen as set forth in claim 15 wherein said dividing strips are approximately 1 mm wide and wherein said flexible aramid fibers are about 0.5 mm in diameter.

20. A vibratory screen as set forth in claim 7 wherein said ribs include upper portions which extend upwardly above said upper surface.

21. A vibratory screen as set forth in claim 20 wherein said upper portions of said ribs include downwardly sloping sides for guiding material into said openings.

22. A vibratory screen as set forth in claim 7 wherein only a single strand of said aramid fibers is positioned in each of said dividing strips, and wherein each of said strands is about 0.5 mm in diameter.

23. A vibratory screen as set forth in claim 7 wherein said side edge portions are formed into U-shaped configurations.

24. A vibratory screen as set forth in claim 7 wherein said side edge portions are encased in U-shaped metal frames which extend longitudinally of said side edge portions.

* * * * *